US005984808A

United States Patent [19]

Fleischer

[11] Patent Number: 5,984,808

[45] Date of Patent: Nov. 16, 1999

[54] GOLF DRIVING AID

[76] Inventor: Donald W. Fleischer, 70 Baneberry La., Wethersfield, Conn. 06109

[21] Appl. No.: 08/941,176

[22] Filed: Sep. 30, 1997

[51] Int. Cl.[6] ..... A63B 57/00

[52] U.S. Cl. ..... 473/388

[58] Field of Search ..... 473/387–403, 473/386

[56] References Cited

U.S. PATENT DOCUMENTS

| | | | |
|---|---|---|---|
| 1,570,743 | 1/1926 | Holli | 473/388 |
| 2,033,269 | 3/1936 | Williams | 473/396 |
| 2,219,732 | 10/1940 | Armstrong | 473/388 |
| 3,288,470 | 11/1966 | Post | 473/396 |
| 3,473,812 | 10/1969 | Pelzmann | 473/396 |
| 3,506,263 | 4/1970 | Arrington | 473/401 |
| 4,367,879 | 1/1983 | Messer | 473/402 |

*Primary Examiner*—Steven Wong

*Attorney, Agent, or Firm*—McCormick, Paulding & Huber LLP

[57] ABSTRACT

An elongated strip of flexible sheet material including at least one surface having a coefficient of friction relative to the surface of a golf ball and/or the striking surface of an associated golf club which is less than the coefficient of friction of the ball surface relative to the striking surface. The shank of a golf tee which supports the golf ball in a "teed-up" position passes through apertures in opposite ends of the strip to maintain the strip in encircling relation to the "teed-up" ball. The strip reduces the magnitude of lateral components of force frictionally transferred to the ball surface by the club striking surface when the ball is driven from the tee by an improperly executed drive thereby reducing the magnitude of a resulting slice or hook.

23 Claims, 3 Drawing Sheets

GOLF DRIVING AID

BACKGROUND OF THE INVENTION AND METHOD

This invention relates in general to golfing aids and deals more particularly with an improved device and method for aiding a golfer to substantially eliminate or at least reduce the magnitude of an undesired slice or hook which may occur when driving a golf ball from a tee.

Many golfers, particularly novices, find that the ball has a tendency to slice or hook when driven from a tee, which often results in a bad lie or a lost ball. Such undesirable slicing or hooking tendencies result from an improperly executed club swing which causes the club face or striking surface of the club to impart undesired spinning motion to the ball. Thus, for example, when a right handed golfer executes an undesired outside-in club swing the club head moves from the outside toward the inside of a proper arc of swing. At the instant of impact the club face is moving toward the inner side of the arc in which the club head is traveling or generally toward the golfer and has a lateral component of motion relative to the ball which is frictionally transferred from the club face to the ball surface thereby imparting a clockwise spin to the ball, as viewed from above. The resulting aerodynamic effect upon the ball causes the ball to slice or travel along an undesired flight path to the right.

If the same golfer executes an undesired inside-out swing, the club head moves from the inner side of a proper arc of swing toward the outer side of the arc thereby producing counterclockwise ball rotation or spin which results in a hook or ball flight toward the left and away from a desired straight flight path. Such undesirable ball spin also increases ball air resistance and reduces the length of a drive. It will also be appreciated that some of the kinetic energy which might otherwise be imparted to the ball to propel it in a desired direction is lost in spinning the ball. This ball spin is most pronounced when the ball is driven from a tee, because maximum club head speed is usually utilized in the drive so that the resulting lateral force component transferred by the club face to and acting upon the ball is maximized. However, it should be understood that there are times when it is desirable to impart spin to a golf ball, as, for example, when applying backspin to stop a ball or when intentionally executing a slice or hook a ball to circumvent an obstacle.

Accordingly, it is a general aim of the present invention to provide an improved golf driving aid for selective use to substantially eliminate an undesired hook or slice or at least reduce the magnitude of such hook or slice when it is desired that a golf ball driven from a tee take a substantially straight flight path.

SUMMARY OF THE INVENTION

A golf driving aid for selective use with a golf ball supported on a golf tee to at least reduce the magnitude of an undesired hook or slice which may occur when the ball is driven from the tee. The device generally comprises at least one strip of sheet material, supporting means for maintaining the strip of sheet material generally adjacent a region of impact on the surface of the golf ball, and compensating means carried by the strip of material for reducing components of force transferred from the face or striking surface of a golf club to the surface of the golf ball and acting upon the ball surface in lateral directions relative to the direction of club swing when the strip is struck proximate the region of impact by the face of the golf club in driving the ball from the tee.

DETAILED DESCRIPTION OF PREFERRED EMBODIMENTS AND METHOD

Figure 1:
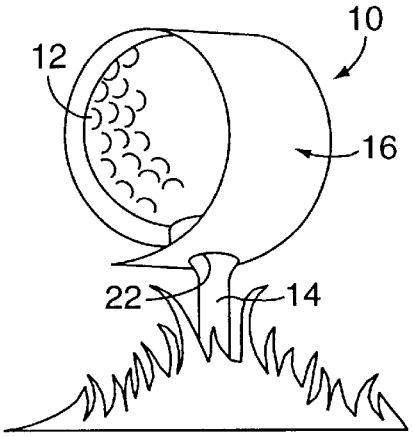
FIG. 1 is a perspective view of a golf driving aid embodying the invention shown positioned relative to a golf ball supported on a golf tee.
Figure 2:
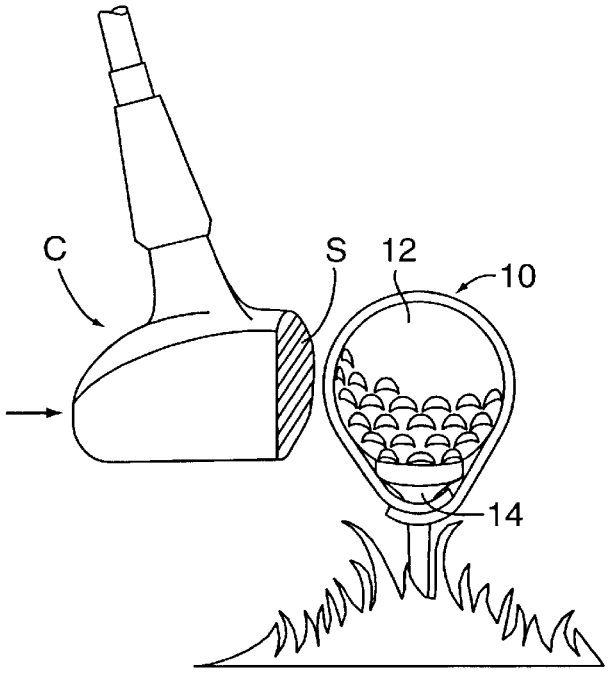
FIG. 2 is a fragmentary side elevational view of the device of FIG. 1 shown with a golf club moving along a driving path relative to the ball.
Figure 3:
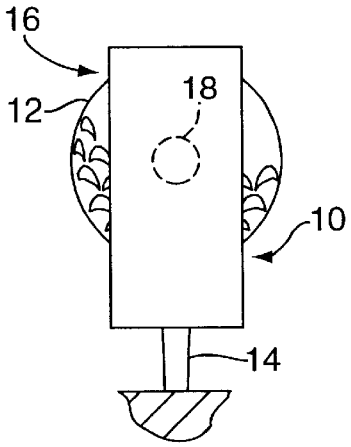
FIG. 3 is a rear elevational view showing the device as it appears in FIGS. 1 and 2.

In the drawing and in the description which follows, a golf driving aid embodying the present invention and indicated generally by the reference numeral 10 is shown positioned for use with a golf ball 12 shown resting in a conventional teed-up position on a golf tee 14. The illustrated device 10 essentially comprises an elongated strip of sheet material indicated generally at 16. A compensating means carried by the strip, and hereinafter further described, reduces the relative coefficient of friction between the surface of the golf ball 12 and the face or striking surface S of an associated golf club, designated generally by the letter C and shown in FIG. 2. The device 10 further includes means for supporting and maintaining the strip of material 16 in general tangential relation to the surface of the golf ball 12 proximate a desired region of impact on the ball surface. The latter region of impact is shown in broken lines in FIG. 3 and indicated by the numeral 18. A presently preferred arrangement for supporting the strip of material to maintain it in position relative to the ball is shown in FIGS. 1–3, wherein the strip is supported and maintained in encircling relation to the golf ball 12 by apertures in the strip which cooperate with the shank portion of the tee 14, as will be hereinafter further discussed.

Figure 4:
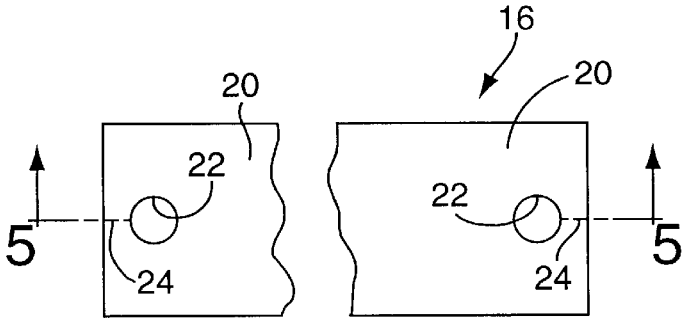
FIG. 4 is a fragmentary plan view of the driving aid of FIGS. 1–3 shown before being positioned on a ball.
Figure 5:
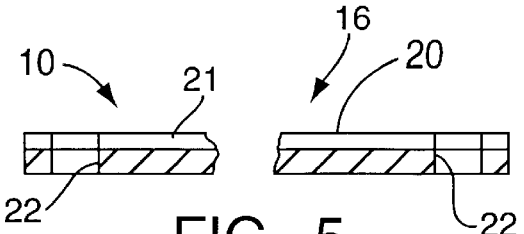
FIG. 5 is a fragmentary sectional view taken along the line 5—5 of FIG. 4.

Referring now to FIGS. 4 and 5, the illustrated strip 16 essentially comprises an elongated strip of flexible sheet material, prefereably paper, having at least one surface 20 which has a coefficient of friction relative to the surface of a golf ball, such as the ball 12, and/or the striking surface of an associated golf club, such as the club C, which is less than the coefficient of friction of the surface of the ball relative to the striking surface of the club. Although the size and shape of the strip are not critical, the presently preferred strip 16 is generally rectangular and approximately 6.5 inches (165.1 millimeters) in length. The width of the strip 16 is at most equal to but does not exceed the diameter of a golf ball. Although the strip 16 is preferably made from treated paper or other frangible material, that is a material which can be easily torn, any suitable material may be used to make the strip. The surface 20 is defined by a coating of material 21 applied to the strip 16 and which has a coefficient of friction relative to the surface of a golf ball, and/or the striking surface of a golf club which is substantially less than the coefficient of friction of the club striking surface relative to the ball surface. Any suitable low friction material may be employed for coating the strip to define the surface 20. However, a dry lubricant, as, for example a waxy substance or a suitable plastic material which possesses the desired low friction characteristic, such as TEFLON, should prove satisfactory for use as a coating material. Apertures 22, 22 are punched through opposite end portions of the strip 16 to receive therethrough the shank portion of a golf tee, such as the tee 14.

Further and in accordance with the invention, a means is provided for weakening the strip 12 in regions of the apertures 22, 22 so that the strip will be easily torn from an associated golf tee upon which it is supported when the strip is struck by an associated golf club, such as the club C, as will be hereinafter further discussed. The illustrated strip 12 is weakened for controlled tearing by lines of weakening or perforation, 24, 24, shown in FIG. 4. Each line of weakening 24 extends between one of the apertures 22 and an associated terminal end of the strip 16, substantially as shown.

Preparatory to using the device 10, the strip 16 is formed into a loop with the apertures 22, 22 in general registry with each other. Thereafter, the shank portion of a golf tee, such as the tee 14, is inserted outwardly through the apertures 22, 22 from the inner side of the loop. The tee with the looped strip attached to it is then pushed into the ground and a golf ball, such as the ball 12, is positioned within the loop and rested upon the tee in a conventional manner. The loop may be adjusted, as necessary, relative to the tee to align the peripheral edges of the looped strip 16 with the desired flight path of the ball. Since the width dimension of the loop is not greater than the diameter of the ball, a golfer should have no difficulty in identifying the desired region of impact on the strip 16 which corresponds to the region of impact 18 on the ball surface, that is the region where the club striking surfaces should engage the strip 16 when the ball is driven from the tee.

When a ball is driven from a tee, the striking surface S of the moving golf club remains in contact with the surface of the ball for a finite period of time during which some deformation or flattening of the ball surface occurs. If the club swing has been properly executed the ball will separate from the striking surface of the club and travel in a direction substantially normal to the striking surface and along a relatively straight flight path. However, if the club head is not traveling along a proper arc of swing when the striking surface engages and impacts the ball, as, for example, when an undesired inside-out or outside-in swing has been executed, the striking face of the club head will have a lateral component of movement relative to the ball during that finite period during which the ball and striking surfaces are in contact. A lateral force component will be frictionally transferred from the laterally moving striking face to the ball causing the ball to spin about a generally vertical axis in one or the opposite direction. The resulting aerodynamic effect upon the ball will cause the ball to either slice or hook away from a desired straight flight path depending upon the direction of lateral movement of the club head relative to the ball and the resulting direction of spin imparted to the ball. The device of the present invention reduces the coefficient of friction between the surface of the ball and the striking surface of the club head during the finite period of time during which the two surfaces are in contact thereby substantially reducing the coefficient of lateral force transferred from the improperly moving club head to the ball whereby the slice or hook which might otherwise be produced by the lateral movement of the club head relative to the ball is substantially reduced, if not entirely eliminated.

The initial impact of the club head upon the device and the ball causes movement of the ball away from the tee thereby tearing the strip 16 away from the tee so that the strip is substantially free of the tee when separation occurs between the striking surface of the club and the surface of the ball in flight. The device remains between and in contact with both the surface of the ball and the striking surface of the club a finite period of time after the ball leaves the tee but does not influence the flight path of the ball as the ball separates from the device.

Figure 6:
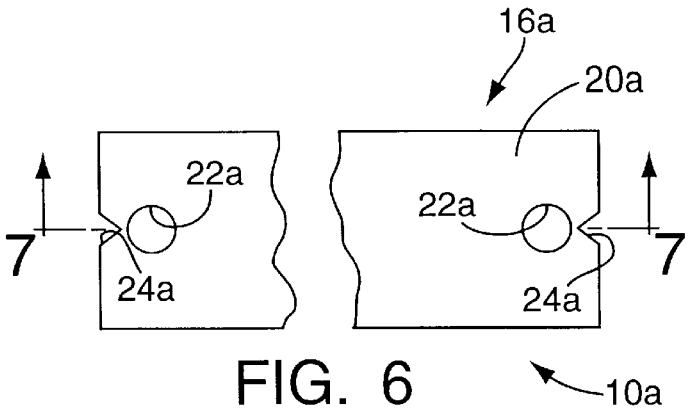
FIG. 6 is a fragmentary plan view similar to FIG. 4 but showing another driving aid embodying the present invention.
Figure 7:
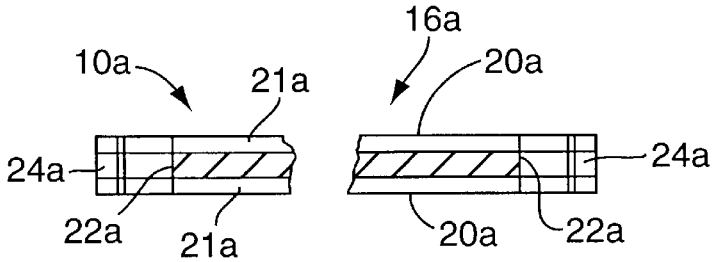
FIG. 7 is a fragmentary sectional view taken along the line 7—7 of FIG. 6.

In FIGS. 6 and 7 there is shown another embodiment of the invention indicated generally at 10*a* and which comprises a strip of material indicated generally by the reference numeral 16*a*. The strip 16*a* is similar in most respects to the previously described paper strip 16, but differs therefrom in that both surfaces of the strip 16*a* are coated with a suitable low friction material 21*a* to provide low friction surfaces 20*a*, 20*a* between the face or striking surface of an associated club and the surface of a golf ball when a portion of the strip 16*a* is interposed between a ball and the striking face of the associated golf club. The strip 16*a* is also weakened in the regions of its apertures 22*a*, 22*a*. These regions of weakening are provided by notches 24*a*, 24*a*. Each notch 24*a* extends from a location on the strip proximate an aperture 22*a* to an associated end edge of the strip 16*b*, substantially as shown. The notches 24*a*, 24*a* provide for controlled tearing and separation of the strip from a golf tee when the strip 16*a* is struck by a golf club, as herein before discussed.

Figure 8:
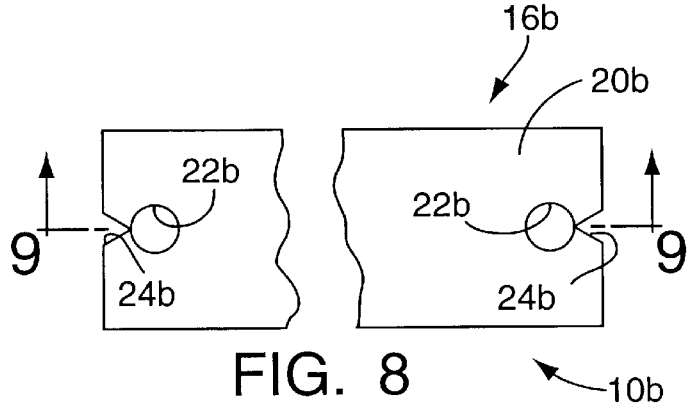
FIG. 8 is similar to FIG. 4 and illustrates still another driving aid.
Figure 9:
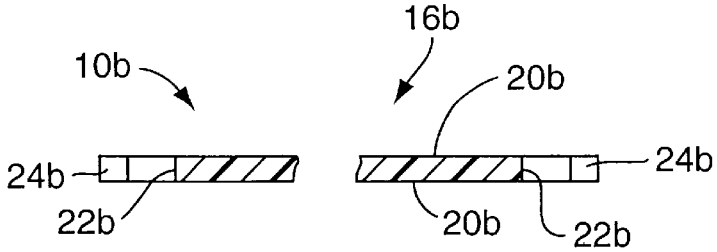
FIG. 9 is a fragmentary sectional view taken along the line 9—9 of FIG. 8.

Referring now to FIGS. 8 and 9, a further embodiment of the invention is disclosed and indicated at 10*b*. The illustrated embodiment 10*b* includes a strip, indicated generally at 16*b* which comprises a flexible strip of homogenous low friction material having opposite sides each of which defines a low friction compensating surface 20*b* in accordance with the invention. The strip 16*b* may be made from any suitable material such as a plastic material having the desired low friction characteristic. However, since the material may be somewhat more resistant to tearing than the paper embodiments hereinbefore described, notches are provided in the ends of the strip 16*b* which open into the apertures 22*b*, 22*b* to provide for controlled separation from a tee.

Figure 10:
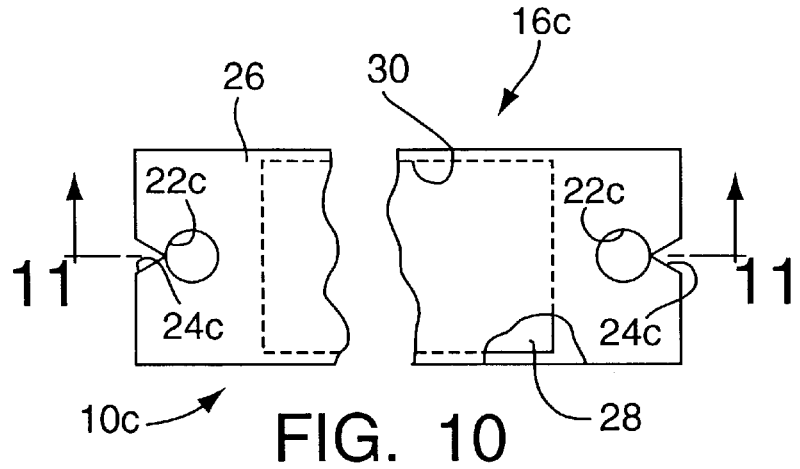
FIG. 10 is a fragmentary plan view similar to FIG. 4 and shows yet another driving aid embodying the present invention.
Figure 11:
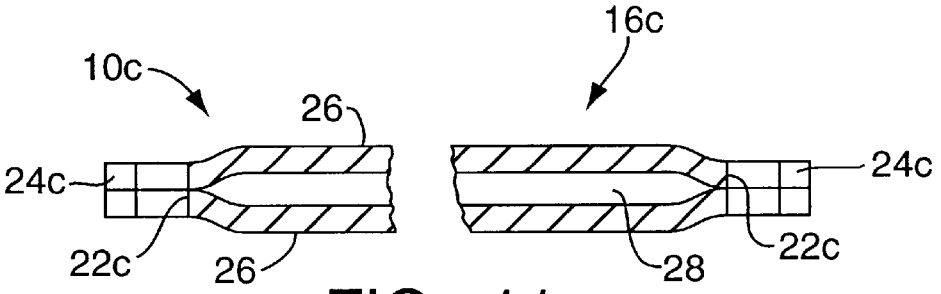
FIG. 11 is a fragmentary sectional view taken along the line 11—11 of FIG. 10.

In FIGS. 10 and 11 there is shown yet another embodiment of the invention indicated at 10*c* which includes a strip 16*c* formed by a laminate. The illustrated laminate 16*c* comprises two strips of flexible sheet material 26, 26 having a layer of lubricant 28, preferably a gel, disposed therebetween. The sheets 26, 26 which form the outer layers of the laminate may comprise any suitable material impervious to the lubricating material 28 contained therebetween or may, for example, be made from a treated sheet material which provides an impervious surface through which the lubricating gel cannot pass. The outer layers 26, 26 are bonded together at least in a region 30 immediately surrounding the layer of lubricant. A suitable adhesive or a heat sealing process may be employed for this purpose.

Figure 12:
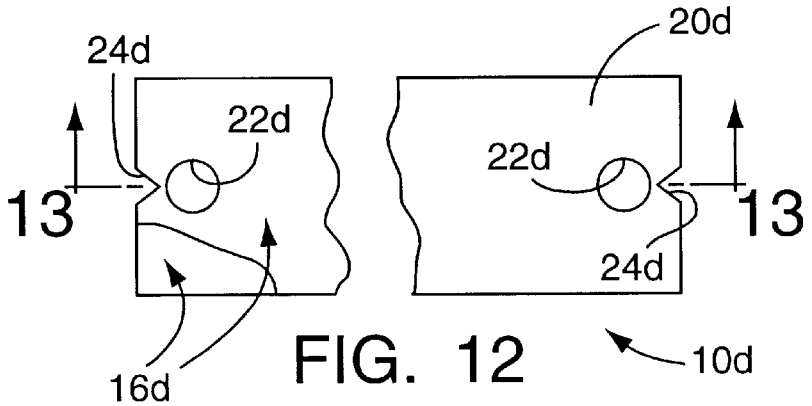
FIG. 12 is similar to FIG. 4 and shows a further driving aid embodying the invention.
Figure 13:
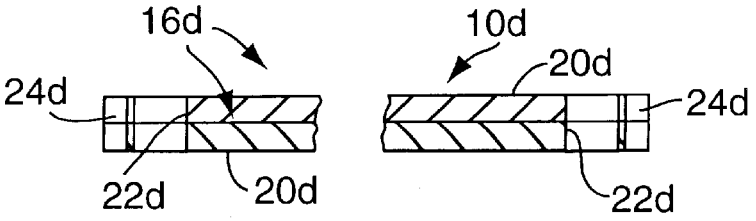
FIG. 13 is a fragmentary sectional view taken along the line 13, 13 of FIG. 12.

Refering now to FIGS. 12 and 13, a still further embodiment of the invention is shown wherein the device, indicated generally at 10*d*, includes two strips of material 16*d*, 16*d*. The strips 16*d*, 16*d* may be made from the same material or different materials and may comprise either connected or discrete strips. The two strips are arranged in face-to-face relation to provide coengaging surfaces indicated at 20*d*, 20*d*. The coengaging surfaces 20*d*, 20*d* have a coefficient of friction relative to each other which is less than the coefficient of friction of the surface of the ball relative to the striking surface of an associated golf club. The strips 16*d*, 16*d* are preferably provided with punched apertures 22*d*, 22*d* and regions of weakening, 24*d*, 24*d* to facilitate separation from a golf tee in the manner hereinbefore described.

I claim:

1. A golf driving aid for use with a golf ball supported thereunder by only a golf tee having an axially elongated and generally axially vertically disposed shank, said golf driving aid comprising an elongated strip of flexible sheet material which may be easily torn, supporting means defined by said sheet material for cooperating with the tee to maintain said strip of sheet material in general tangential relation to the golf ball surface proximate a desired region of impact on the ball surface, and compensating means carried by said strip of sheet material for reducing components of force transferred by the strip of sheet material to the ball surface and acting upon the ball surface in a generally lateral direction relative to the path of club swing when the strip of sheet material is struck by the striking surface of a golf club in the desired region of impact to drive the golf ball from the tee.

2. A golf driving aid as set forth in claim 1 wherein said compensating means comprises a surface of said strip of sheet material coengageable with the striking surface.

3. A golf driving aid as set forth in claim 1 wherein said compensating means comprises a surface of said strip of sheet material coengageable with the ball surface.

4. A golf driving aid as set forth in claim 1 wherein said strip of sheet material comprises a laminate including layers of sheet material and said compensating means comprises a pair of opposing surfaces on said strip of sheet material, said opposing surfaces having a coefficient of friction relative to each other which is adapted to be less than the coefficient of friction of the striking surface relative to the ball surface.

5. A golf driving aid for use with a golf ball supported by a tee having an axially elongated and generally axially vertically disposed shank, said golf driving aid comprising a strip of laminated sheet material including layers of sheet material having opposing surfaces, supporting means defined by said strip of laminated sheet material for cooperating with the tee to maintain said strip of laminated sheet material in generally tangential relation to the golf ball surface proximate a desired region of golf club impact on the ball surface, and compensating means carried by said strip of laminated sheet material for reducing components of force transferred by the strip to the ball surface and acting upon the ball surface in a generally lateral direction relative to the path of golf club swing when the strip of sheet material is struck by the surface of a golf club in the desired region of golf club impact to drive the golf ball from the tee, said compensating means including said opposing surfaces of said layers.

6. A golf driving aid as set forth in claim 5 wherein said laminate includes lubricating material disposed between said layers of sheet material and engaging said opposing surfaces of said sheet material.

7. A golf driving aid as set forth in claim 6 wherein said said layers of sheet material are sealed together in face-to-face relation around the peripheral edges thereof.

8. A golf driving aid as set forth in claim 1 wherein said strip of sheet material comprises a loop of sheet material for encircling the golf ball supported by the golf tee.

9. A golf driving aid as set forth in claim 8 wherein said strip of sheet material comprises a rectangular strip of sheet material.

10. A golf driving aid as set forth in claim 9 wherein the width of said rectangular strip of sheet material is at most substantially equal to the diameter of the golf ball.

11. A golf driving aid as set forth in claim 1 wherein said strip of sheet material has overlapping opposite end portions and said supporting means comprises apertures defined by said end portions and receiving an associated portion of the shank therethrough.

12. A golf driving aid for use with a golf ball supported by a golf tee having an axially elongated and generally axially vertically disposed shank, said golf driving aid comprising a strip of sheet material which may be easily torn, supporting means defined by said strip of sheet material for cooperating with the tee to maintain said strip of sheet material in generally tangential relation to the golf ball surface proximate a desired region of golf club impact on the ball surface and including overlapping opposite end portions of said strip of sheet material defining apertures therethrough, for allowing the shank to extend through said apertures, and compensating means carried by said strip of sheet material for reducing components of force transferred by the strip to the ball surface and acting upon the ball surface in a generally lateral direction relative to the path of golf club swing when the strip of sheet material is struck by the striking surface of a golf club in the desired region of golf club impact to drive the golf ball from the tee.

13. A golf driving aid as set forth in claim 12 wherein said golf driving aid includes weakening means for controlling tearing separation of said strip of sheet material from an associated tee when the ball is driven from the tee.

14. A golf driving aid as set forth in claim 13 wherein said weakening means comprises a line of perforation on said strip of sheet material.

15. A golf driving aid as set forth in claim 13 wherein said weakening means comprises a notch in said strip in the region of an associated one of said apertures.

16. A golf driving aid as set forth in claim 1 wherein said golf driving aid comprises two strips of material and said compensating means comprises coengaging surfaces on said two strips, one of said coengaging surfaces having a coefficient of friction relative to the other of said coengaging surfaces which is adapted to be less than the coefficient of friction of the striking surfaces relative to the ball surface.

17. A golf driving aid for use with a golf ball supported on a golf tee, said driving aid comprising an axially elongated flexible strip of frangible sheet material having opposite end portions and apertures through said opposite end portions, said strip of sheet material forming a loop for encircling the golf ball, said opposite end portions being disposed in overlapping relation to each other with said apertures in general registry with each other, for the golf tee to extend through said apertures, and compensating means carried by said strip of sheet material for reducing the magnitude of components of force acting upon the golf ball in transverse directions relative to the path of swing of a golf club having a striking surface when the striking surface engages the strip to drive the golf ball from the golf tee.

18. A golf driving aid as set forth in claim 17 wherein said compensating means comprises a surface of said strip of material coengageable with the ball surface.

19. A golf driving aid for use with a golf ball supported thereunder by only a golf tee having an axially elongated and generally axially vertically disposed shank, said golf driving aid comprising a loop of frangible sheet material for encircling the golf ball supported by the golf tee, supporting means defined by said strip of material for cooperating with the tee to maintain said loop of sheet material in generally tangential relation to the golf ball surface proximate a desired region of golf club impact on the ball surface and compensating means carried by the strip of material for reducing components of force transferred by the strip to the ball surface and acting upon the ball surface in a generally lateral direction relative to the path of golf club swing when the strip is struck by the striking surface of a golf club in the desired region of golf club impact to drive the golf ball from the tee.

20. A method for driving a golf ball from a tee to reduce the effect of adverse club swing upon the ball and comprising the steps of providing a piece of sheet material, forming the piece of sheet material into a loop having overlapping end portions, inserting the shank portion of the tee from the inner-side of the loop outwardly through the overlapping end portions of the loop to extend beyond the outer-side of the loop to maintain the sheet material with a surface of the sheet material in general contact with the surface of the ball proximate a desired region of impact on the surface of the ball, pressing the extending outer-end portion of the tee shank into the ground, positioning the ball on the tee and within the loop, and striking the loop with the striking surface of the club proximate the region of contact between the sheet material and the surface of the ball with the striking surface of a golf club to drive the ball from the tee.

21. A golf driving aid as set forth in claim 17 wherein said compensating means comprises a surface of said strip of material coengageable with the striking surface.

22. A golf driving aid comprising a golf tee, an elongated flexible strip of sheet material mounted on and supported by only said golf tee, said strip of sheet material forming a loop for encircling a golf ball resting on said golf tee, and compensating means carried by said strip of sheet material for reducing the magnitude of components of force acting upon the golf ball in transverse directions relative to the path of swing of a golf club having a striking surface when the striking surface engages the strip to drive the golf ball from said golf tee.

23. A golf driving aid as set forth in claim 1 wherein said strip of sheet material is further characterized as a strip of paper.

* * * * *